US005902978A

United States Patent [19]

Zehnder et al.

[11] Patent Number: 5,902,978

[45] Date of Patent: May 11, 1999

[54] POWER BREAKER

[75] Inventors: Lukas Zehnder, Baden, Dättwil; Robert Anderes, Siebnen; Bodo Brühl, Künten; Christian Dähler, Küsnacht; Ion Gavrilita, Wettingen; Joachim Stechbarth, Siglistorf; Kurt Kaltenegger, Lengnau, all of Switzerland

[73] Assignee: Asea Brown Boveri AG, Baden, Switzerland

[21] Appl. No.: 08/832,290

[22] Filed: Apr. 3, 1997

[30] Foreign Application Priority Data

Apr. 4, 1996 [DE] Germany ..... 196 13 569

[51] Int. Cl.[6] ..... H01H 33/86

[52] U.S. Cl. ..... 218/57; 218/48; 218/51

[58] Field of Search ..... 218/60, 59, 61, 218/51, 46, 52, 57, 62, 63, 48, 74

[56] References Cited

U.S. PATENT DOCUMENTS

| | | | |
|---|---|---|---|
| 4,486,632 | 12/1984 | Niemeyer et al. | 218/57 |
| 4,650,941 | 3/1987 | Thuries et al. | 218/60 X |

FOREIGN PATENT DOCUMENTS

| | | | |
|---|---|---|---|
| 3130366 | 10/1982 | Germany | 218/74 |
| 3127962A1 | 1/1983 | Germany . | |
| 4200896A1 | 7/1993 | Germany . | |
| 295 09 015 U 1 | 9/1995 | Germany . | |
| 4427163A1 | 2/1996 | Germany . | |
| 644969 | 8/1984 | Switzerland . | |
| 651420A5 | 9/1985 | Switzerland . | |

*Primary Examiner*—Renee S. Luebke

*Attorney, Agent, or Firm*—Burns, Doane, Swecker & Mathis, L.L.P.

[57] ABSTRACT

This power breaker has at least one quenching chamber, which is filled with an insulating medium, is of cylindrical design, extends along a central axis (2) and has a power current path, having two stationary consumable contact arrangements (5, 6) which are arranged on the central axis (2), are at a distance from one another in the axial direction and are arranged in the power current path. In the connected state, the consumable contact arrangements (5, 6) are electrically conductively connected by means of a moving bridging contact. An arc zone (24) is provided between the consumable contact arrangements (5, 6). A rated current path is arranged in parallel with the power current path. The power breaker is provided with at least one source for a highly pressurized insulating medium. The medium passes from this source directly into the arc zone (24), through at least one injection channel (62, 63). This high-pressure injection considerably improves the breaking capacity of the power breaker.

14 Claims, 8 Drawing Sheets

POWER BREAKER

BACKGROUND OF THE INVENTION

1. Field of the Invention

The invention is based on a power breaker having at least one quenching chamber, and in particular, to a power breaker having two stationary consumable contact arrangements and a moving bridging contact which electrically conductively connects the consumable contact arrangements.

2. Discussion of Background

Laid-open specification DE 42 00 896 A1 discloses a power breaker which has a quenching chamber with two stationary consumable contacts which are at a distance from one another. The quenching chamber is filled with an insulating gas, preferably $SF_6$ gas under pressure. When the quenching chamber is in the connected state, the two consumable contacts are electrically conductively connected to one another by means of a moving bridging contact. The bridging contact concentrically surrounds the consumable contacts, which are of cylindrical design. The bridging contact and the two consumable contacts form a power current path, on which current acts only during disconnection. During disconnection, the bridging contact slides down from a first of the consumable contacts and draws an arc which initially burns between the first consumable contact and the end of the bridging contact facing it. As soon as this end reaches the second consumable contact, the arc base commutates from the end of the bridging contact onto the second consumable contact. The arc now burns between the two consumable contacts and is blown until the arc is quenched. The pressurized insulating gas which is required for blowing is, as a rule, produced by means of a blowout piston which is connected to the moving bridging contact.

In addition, this power breaker has a rated current path in parallel with the power current path, which rated current path carries the operational current when the power breaker is switched on. The rated current path is arranged concentrically around the power current path. The bridging contact is in this case mechanically rigidly connected to a moving rated current contact which is arranged in the rated current path. During disconnection, the rated current path is interrupted first, and the current to be interrupted then commutates onto the power current path where, as described above, an arc is then struck and is then quenched.

Because of its dimensions, the bridging contact has a comparatively large mass to be moved, which must first be accelerated and then braked during switching processes. The power breaker drive has to provide the power required for this process.

Laid-open specification DE 31 27 962 A1 discloses a further power breaker which has a quenching chamber with two stationary consumable contacts at a distance from one another. The quenching chamber is filled with an insulating gas, preferably $SF_6$ gas under pressure. When the quenching chamber is in the connected state, the two consumable contacts are electrically conductively connected to one another by means of a moving bridging contact. The bridging contact concentrically surrounds the consumable contacts, which are of cylindrical design. The bridging contact is in this case at the same time designed as a rated current contact. The disconnection process of this power breaker is similar to that for the power breaker described above.

Because of its dimensions, this bridging contact likewise has a comparatively large mass to be moved, which must be accelerated and braked during switching processes. The power breaker drive must provide the power required for this purpose.

Patent Specification CH 651 420 discloses a power breaker which has a stationary blowout volume into which insulating gas is fed which is produced from a pressure source and is subject to high pressure. The high pressure is reduced during entry into the blowout volume, so that only a comparatively low blowout pressure is available for blowing out the arc.

Patent Specification CH 644 969 discloses a power breaker which has two series-connected blowout volumes. The pure insulating gas which is present in the first blowout volume is compressed by means of a piston during the disconnection movement of the moving power contact. In addition, hot gas which is heated in the arc zone flows from the arc into this first blowout volume, is mixed with the pure insulating gas to form a gas mixture, and thus increases the pressure in this first blowout volume. After a predetermined movement of the moving power contact, a second blowout volume is disconnected from the first blowout volume, and the gas mixture in the two blowout volumes is then further compressed as a function of the movement. During the further course of the disconnection movement, both blowout volumes interact, independently of one another, with the pressure in the arc zone of this power breaker. However, it is necessary to take account of the fact that gas mixture pressures in approximately the same order of magnitude range prevail in each case at the same point in time in the two blowout volumes, it being possible, because of the larger cross section of the connection of the first blowout volume, which is somewhat reduced in terms of volume, to the arc zone for somewhat higher pressures to occur momentarily in this first blowout volume than in the second blowout volume. These pressure differences are caused just by the thermal effects of the arc. The rise in pressure in the two blowout volumes will differ from one disconnection to the next, depending on the magnitude of the current to be interrupted and on the instant of contact separation.

SUMMARY OF THE INVENTION

Accordingly, one object of the invention is to provide a novel power breaker of the type mentioned initially, which has an improved breaking capacity.

The power breaker is provided with high-pressure injection which allows the blowout pressure in the arc zone to be increased as required. The high-pressure injection takes place directly into the arc zone, as a result of which particularly intensive blowing of the arc is possible. Comparatively high blowout pressures are reached using simple means in the case of the power breaker according to the invention.

The power breaker has stationary consumable contact arrangements which are connected to a bridging contact. Since the bridging contact is arranged in the interior of the consumable contact arrangements, it can be designed with an advantageously small diameter and thus with a particularly low mass. The bridging contact is in this case designed as a simple contact pin which has no sprung contact elements and can therefore be produced relatively easily and cost-effectively.

This power breaker is driven at a comparatively high disconnection speed, since the comparatively low mass of the bridging contact can be effectively accelerated, and can also be braked reliably at the end of the disconnection movement, using a drive which is comparatively small and advantageously cheap.

The moving rated current contact is moved considerably more slowly than the contact pin which is connected to it via a lever linkage which reduces the speed. Because of the lower mechanical stress, the life of the rated current contacts is advantageously increased, which considerably improves the availability of the power breaker. In addition, the moving rated current contact is accommodated in a volume which is completely separated from the region of the power breaker in which hot gases and erosion particles produced by the arc occur. These hot gases and erosion particles can therefore have no negative influence on the rated current contacts, as a result of which their stability and thus their life are advantageously increased.

A further advantageous reduction in the cost of the power breaker according to the invention results from the fact that the consumable contact arrangements and, to some extent, the housing parts as well are constructed from identical parts in mirror-image symmetry with respect to a plane of symmetry.

As a means for increasing the blowout pressure, the power breaker has at least one compression unit with at least one first piston-cylinder arrangement which has at least two series-connected pistons, of which a first compression piston precompresses the insulating medium in a first compression volume, and a second compression piston further compresses the precompressed insulating medium in a second compression volume, which is separated from the first compression volume. This further-compressed insulating medium is introduced directly into the center of the arc zone through at least one injection channel. This compression in two successive stages results in a particularly high blowout pressure, which allows the arc to be blown particularly intensively.

The further refinements of the invention are the subject matter of the dependent claims.

The invention, its development and the advantages which can be achieved thereby will be explained in more detail in the following text with reference to the drawing, which illustrates only one possible means of implementation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Those elements which are not required for immediate understanding of the invention are not illustrated.

DESCRIPTION OF THE PREFERRED EMBODIMENTS

Figure 1:
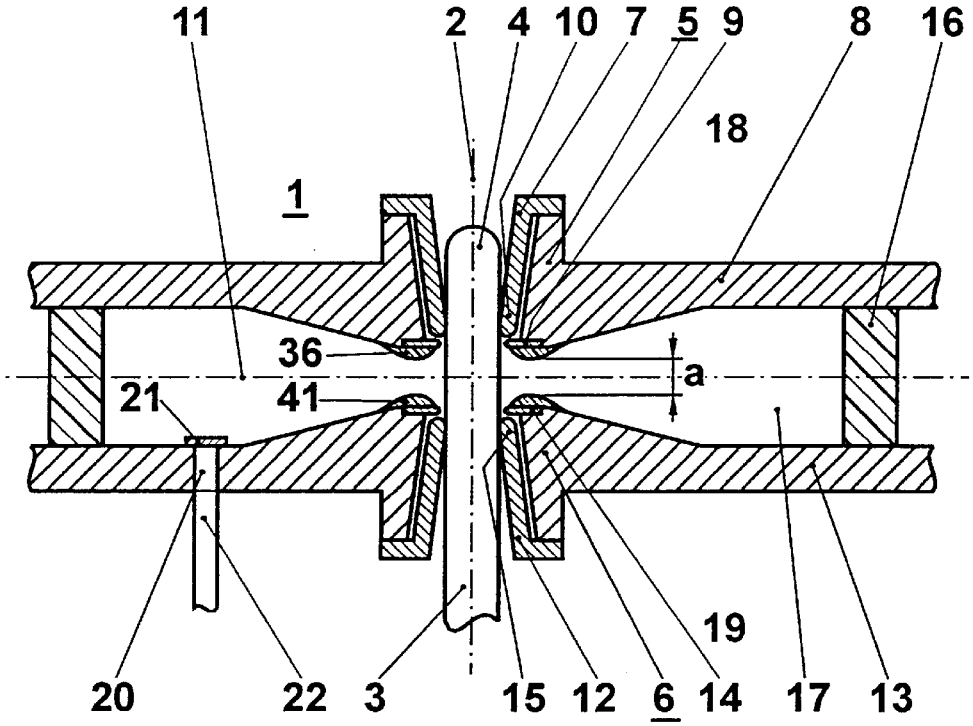
FIG. 1 shows a section through the schematically illustrated contact zone of a first embodiment of a power breaker according to the invention in the connected state.

Referring now to the drawings, wherein like reference numerals designate identical or corresponding parts throughout the several views, FIG. 1 shows a schematically illustrated section through the contact zone 1 of the quenching chamber of one embodiment of a power breaker according to the invention in the connected state. The quenching chamber is arranged centrally, symmetrically about a central axis 2. A metallic contact pin 3 extends along this central axis 2, which contact pin 3 is of cylindrical design and can be moved along the central axis 2 by means of a drive, which is not illustrated. The contact pin 3 has a dielectrically favorably shaped tip 4 which, if required, can be provided with an electrically conductive, erosion-resistant material. In the connected state, the contact pin 3 electrically conductively bridges a distance a between two consumable contact arrangements 5, 6.

The consumable contact arrangement 5 has a schematically illustrated contact plunger 7 which is electrically conductively connected to a step on a carrier 8 which is designed in the form of a plate and is made of metal. The contact plunger 7 has contact fingers made of metal which rest in a sprung manner on the surface of the contact pin 3. On the side of the carrier 8 facing the consumable contact arrangement 6, a consumable plate 9 has been connected to this carrier 8 using one of the known methods, to be precise in such a manner that the ends 10 of the contact fingers are protected against erosion. The consumable plate 9 is preferably manufactured from graphite, but it may also be made of any other electrically conductive, erosion-resistant materials such as sintered tungsten copper compounds, for example. That surface of the consumable plate 9 which faces away from the carrier 8 is protected against any arc influence by means of a cover 36 which is designed in an annular shape and is made of erosion-resistant insulating material. In addition, the cover 36 prevents the arc base migrating too far into the storage volume 17.

The consumable contact arrangement 6 corresponds in design to the consumable contact arrangement 5, but is arranged in mirror-image symmetry with respect to it. A dashed-dotted line 11 indicates the plane of mirror-image symmetry. The consumable contact arrangement 6 has a schematically illustrated contact plunger 12 which is electrically conductively connected to a step on a carrier 13 which is designed in the form of a plate and is made of metal. The contact plunger 12 has contact fingers made of metal, which rest in a sprung manner on the surface of the contact pin 3. On that side of the carrier 13 which faces the consumable contact arrangement 5, an erosion plate 14 has been connected to this carrier 13 using one of the known methods, to be precise such that the ends 15 of the contact fingers are protected against erosion. The consumable plate 14 is preferably manufactured from graphite, but it may also be made of any other electrically conductive, erosion-resistant materials such as sintered tungsten copper compounds, for example. That surface of the consumable plate 14 which faces away from the carrier 13 is protected against any arc influence by means of a cover 41 which is designed in an annular shape and is made of erosion-resistant insulating material. In addition, the cover 41 prevents the arc base migrating too far into the storage volume 17. The two covers 36 and 41 in this embodiment variant form an annular nozzle channel whose constriction has the separation a.

An annular separating wall 16, which is arranged concentrically with respect to the central axis 2 and is made of insulating material, is clamped in between the carriers 8 and 13. The carriers 8 and 13 and the separating wall 16 enclose a storage volume 17 which is of annular design and is designed to store the pressurized insulating gas which is provided for blowing out the arc. The carrier 8 represents one end of an evacuation volume 18 which is designed cylindrically and is completely surrounded by metallic walls. The carrier 13 represents one end of an evacuation volume 19 which is designed cylindrically and is completely surrounded by metallic walls. If a rated current path is provided, then, when the power breaker is in the connected state, this represents the electrically conductive connection between the metallic walls of the two evacuation volumes 18 and 19.

The carrier 13 is provided with a hole 20 which is closed by a schematically illustrated check valve 21. A line 22 is connected to the hole 20 and carries the insulating gas to the storage volume 17, so that insulating gas having been compressed during a disconnection process by a piston-cylinder arrangement which is operatively connected to the contact pin 3. However, the pressurized insulating gas can flow into the storage volume 17 only when the pressure in the storage volume 17 is less than in the line 22.

Figure 2:
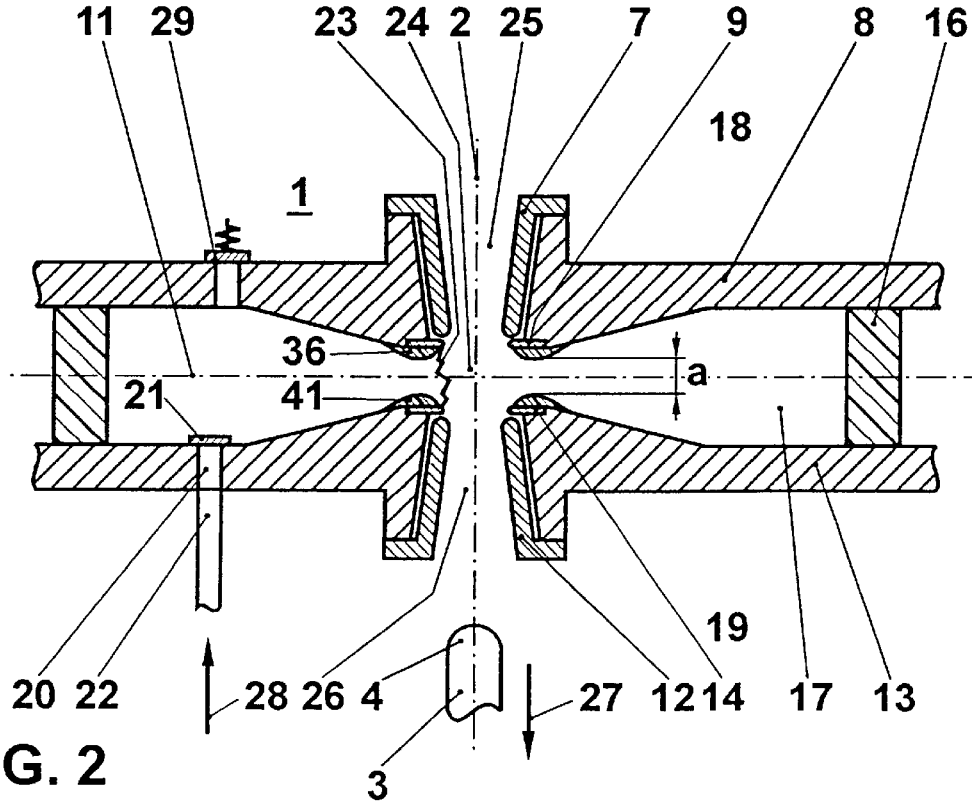
FIG. 2 shows a section through the schematically illustrated contact zone of a first embodiment of a power breaker according to the invention during disconnection.

FIG. 2 shows a schematically illustrated section through the contact zone 1 of one embodiment of the quenching chamber of a power breaker according to the invention during disconnection. The contact pin 3 has drawn an arc between the consumable plates 9 and 14 in the course of its disconnection movement in the direction of the arrow 27. The arc 23 acts thermally on the insulating gas surrounding it and thus briefly increases the pressure in this region of the quenching chamber, which is located in the interior between the consumable contact arrangements 5 and 6 and is called the arc zone 24. The pressurized insulating gas is briefly stored in the storage volume 17. Part of the pressurized insulating gas flows, however, on the one hand through an opening 25 into the adjacent evacuation volume 18 and, on the other hand, through an opening 26 into the adjacent evacuation volume 19.

The contact pin 3 is connected to a piston-cylinder arrangement in which insulating gas is compressed during a disconnection process. As an arrow 28 indicates, this compressed insulating gas is introduced through the line 22 into the storage volume 17 if the pressure in the storage volume 17 is less than in the line 22. For example, this is the case if the current in the arc 23 is so weak that it cannot heat the arc zone 24 intensively enough. However, if a heavy current arc 23 heats the arc zone 24 to a major extent, so that a high pressure occurs in the insulating gas in the storage volume 17, an overpressure valve 29 opens after a predetermined limit has been exceeded, and the excess pressure is dissipated into the evacuation volume 18. Alternatively, it is possible to dispense with the overpressure valve 29, if the openings 25 and 26 are appropriately dimensioned.

Figure 3:
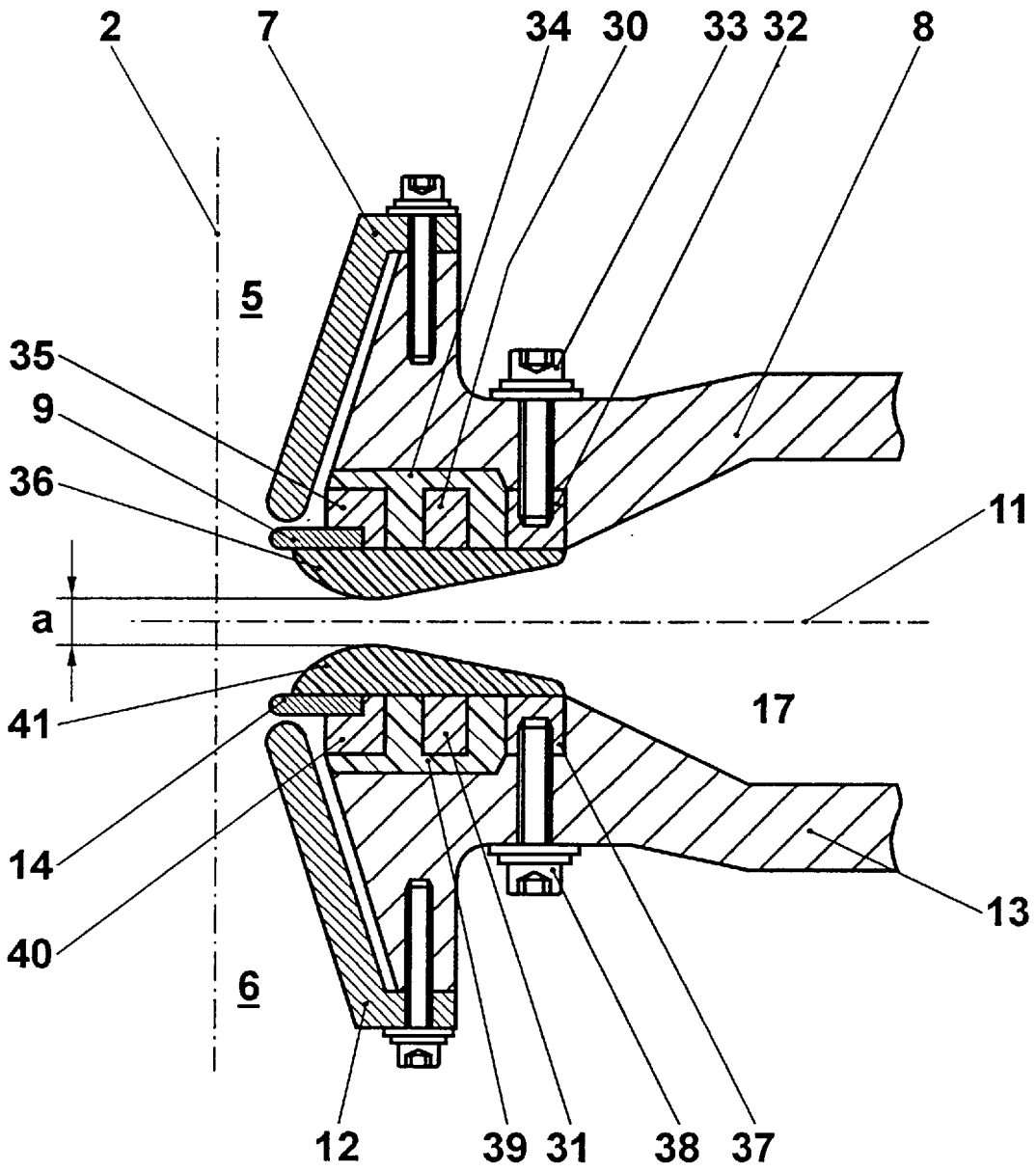
FIG. 3 shows a partial section through the schematically illustrated contact zone of a second embodiment of a power breaker according to the invention.

If the arc 23 is caused to rotate about the central axis 2, then, as is known, the heating of the arc zone 24 is thus considerably reinforced. FIG. 3 shows a partial section through a contact zone, which is provided with blowout coils 30 and 31, of a power breaker according to the invention in the disconnected state. The magnetic field of the blowout coils 30 and 31 causes the arc 23 to rotate, in a known manner, during disconnection. The blowout coil 30 is introduced into a depression in the carrier 8, one winding end 32 having a metallically bare contact surface which is pressed by means of a screw 33 against the metallically bare surface of the carrier 8. The winding end 32 is thus electrically conductively connected to the carrier 8. Electrical insulation 34 is provided between the carrier 8 and the rest of the surface of the blowout coil 30 facing the carrier 8. This insulation 34 also spaces the turns of the blowout coil 30 from one another. The other winding end 35 of the blowout coil 30 is electrically conductively connected to the consumable plate 9. That surface of the blowout coil 30 which faces away from the carrier 8, and a part of the surface of the consumable plate 9, are protected against any arc influence by means of a cover 36 made of an erosion-resistant insulating material.

The blowout coil 31 is introduced into a depression in the carrier 13, one winding end 37 having a metallically bare contact surface which is pressed by means of a screw 38 against the metallically bare surface of the carrier 13. The winding end 37 is thus electrically conductively connected to the carrier 13. Electrical insulation 39 is provided between the carrier 13 and the rest of the surface of the blowout coil 31 facing the carrier 13. This insulation 39 also spaces the turns of the blowout coil 31 from one another. The other winding end 40 of the blowout coil 31 is electrically conductively connected to the consumable plate 14. That surface of the blowout coil 31 which faces away from the carrier 13, and a part of the surface of the consumable plate 14, are protected against any arc influence by means of a cover 41 made of an erosion-resistant insulating material.

The two blowout coils 30 and 31 are arranged such that the magnetic fields produced by these blowout coils 30 and 31 reinforce one another. The blowout coils 30 and 31 may be used in any of the embodiment variants of the present power breaker. In the case of this embodiment variant, the two covers 36 and 41 form an annular nozzle channel whose constriction has the separation a and expands in the radial direction until it merges into the storage volume 17.

Figure 4:
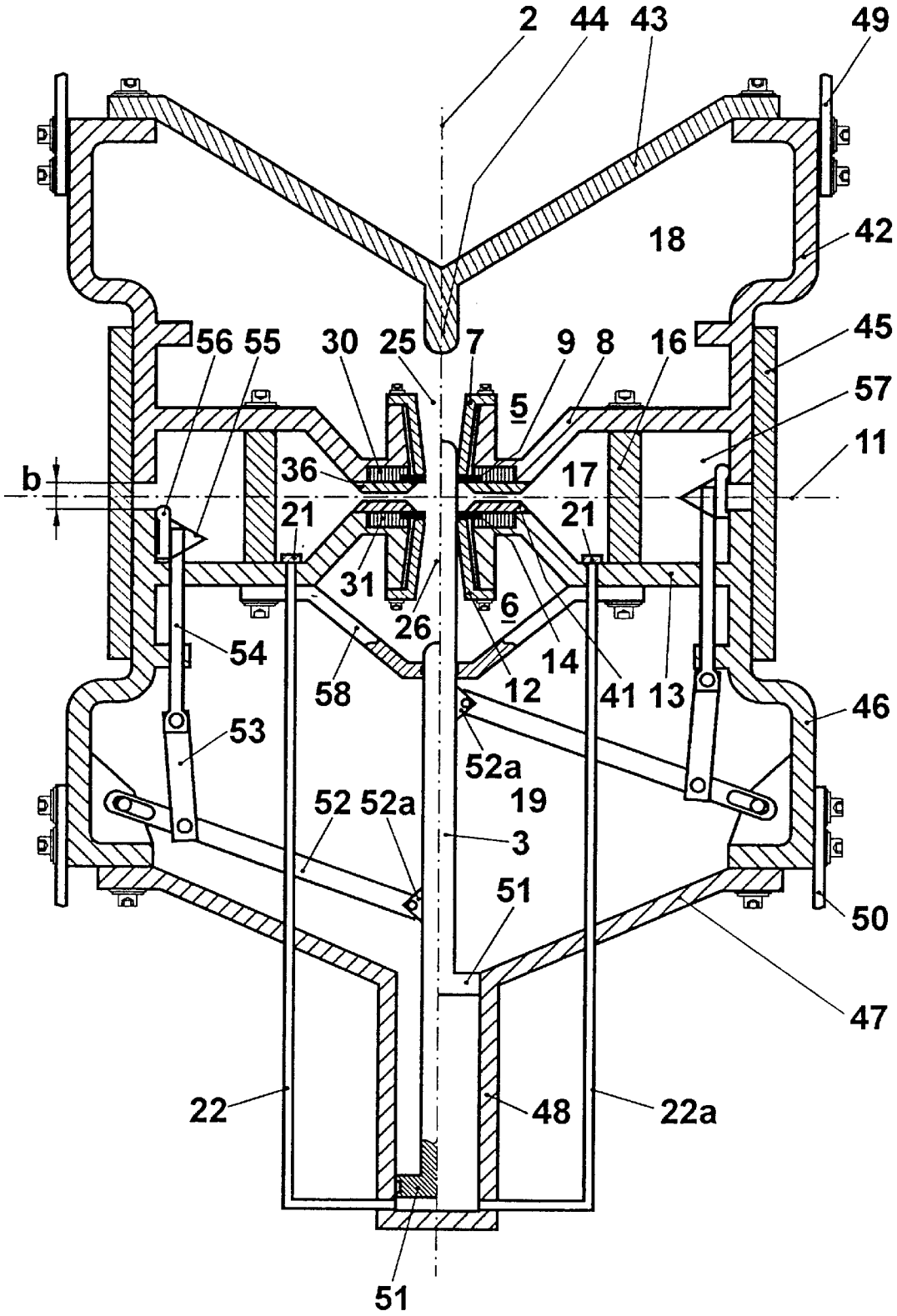
FIG. 4 shows a highly simplified section through a power breaker according to the invention, the power breaker being illustrated in the connected state in the right-hand half of the figure, and the power breaker being illustrated in the disconnected state in the left-hand half of the figure.

FIG. 4 shows a highly simplified section through a schematically illustrated power breaker according to the invention, the power breaker being illustrated in the connected state in the right-hand half of the figure, and the power breaker being illustrated in the disconnected state in the left-hand half of the figure. The power breaker is constructed concentrically around the central axis 2. The evacuation volume 18, which is filled with insulating gas under pressure, preferably $SF_6$ gas, is enclosed by the carrier 8, a cylindrically designed housing wall 42 which is connected to this carrier 8, and a closure cover 43 which is opposite the carrier 8 and is screwed to the housing wall 42 in a pressure-tight manner. The closure cover 43 is provided in the center with a cylindrically designed flow deflector 44 which extends in the direction of the opening 25. As a rule, the housing wall 42 and the closure cover 43 are produced from an electrically highly conductive metal, in the same way as the carrier 8.

The housing wall 42 is connected to a cylindrically designed insulating tube 45 in a pressure-tight manner. The insulating tube 45 is connected, on the side opposite the housing wall 42, in a pressure-tight manner to a further cylindrically designed housing wall 46. The housing wall 46 is designed in precisely the same manner as the housing wall 42, but is arranged in mirror-image symmetry with respect to it, the dashed-dotted line 11 indicating the plane of mirror-image symmetry. The insulating tube 45 is arranged concentrically in respect to the insulating separating wall 16. This housing wall 46 is connected to the carrier 13. The evacuation volume 19, which is filled with insulating gas under pressure, preferably $SF_6$ gas, is enclosed by the carrier 13, the housing wall 46 which is connected to said carrier 13, and a cover 47 which is opposite the carrier 13 and is screwed to the housing wall 46 in a pressure-tight manner. The cover 47 is provided in the center with a cylinder 48. As a rule, the housing wall 46 and the cover 47 are produced from an electrically highly conductive metal, like the carrier 13. Separation b is provided between the two housing walls 42 and 46. The housing wall 42 is provided on the outside with fastening means for electrical connections 49. The housing wall 46 is likewise provided on the outside with fastening means for electrical connections 50. The insulating tube 45 is arranged in a depression which is formed by the two housing walls 42 and 46 and is of annular design, as a result of which the tension forces which are caused by the pressure in the evacuation volumes 18 and 19 and act on the insulating tube 45 in the axial direction are minimized. As a result of this depressed arangement, the outer surface of the insulating tube 45 is particularly well protected against transportation damages.

A compression piston 51, which is connected to the contact pin 3, slides in the cylinder 48. The compression piston 51 is designed, and is provided with piston rings made of insulating material, such that no stray currents can flow from the contact pin 3 into the wall of the cylinder 48. During the disconnection movement of the contact pin 3, the compression piston 51 seals the insulating gas which is located in the cylinder 48. The compressed insulating gas flows through the schematically illustrated lines 22 and 22*a* into the storage volume 17, if the pressure conditions in this volume allow this. If an excessive compression pressure were to occur in this cylinder 48, then this can be dissipated into the evacuation volume 19 by means of an overpressure valve, which is not illustrated.

The compression piston 51, the lines 22 and 22*a*, and the check valve 21 may also be omitted in possible other embodiment variants of this power breaker.

The contact pin 3 is moved by a drive, which is not illustrated. At least one lever 52 is hinged on the contact pin 3. One end of the lever 52 is held, such that it can rotate, in a bearing 52*a* which is connected to the contact pin 3. The other end of the lever 52 is in this case mounted in the housing wall 46 such that it can rotate and can be displaced. A rocker arm 53 is connected to the lever 52 such that it can rotate, and transmits the force, which is exerted by the lever 52, to a rod 54 which is hinged on it. The rod 54 is moved parallel to the direction of the central axis 2, and is in this case guided with little friction in the housing wall 46 and in the carrier 13. The other end of the rod 54 is connected to a finger cage 55, which is illustrated schematically as a triangle. The finger cage 55 is used as a holder for a multiplicity of contact fingers 56 which are attached in a sprung manner. In order to prevent tilting, at least two such lever linkages are provided for the operation of the finger cage 55, as is illustrated in FIG. 4. In the connected state, the contact fingers 56 form the moving part of the rated current path of the power breaker. The finger cage 55 is illustrated with the power breaker in the connected state in the right-hand part of FIG. 4, the contact fingers 56 bridging the distance b in an electrically conductive manner in this position. The current through the power breaker now flows, for example, from the electrical connections 49, through the housing wall 42, through the contact fingers 56 and the housing wall 46, to the electrical connections 50.

The space 57 in which this moving part of the rated current path is accommodated is highly advantageously completely separated from the arc zone 24 by means of the insulating separating wall 16 and the carriers 8 and 13, so that no erosion particles which are produced in the arc zone 24 can enter the region of the rated current contacts and influence them in a negative manner. The life of the rated current contacts, in particular the wear resistance of the contact surfaces, is thus very advantageously increased, which results in advantageously increased availability of the power breaker.

The lever linkages, which in each case comprise a lever 52, a rocker arm 53 and a rod 54, are designed such that the comparatively high disconnection speed of the contact pin 3 which is produced by the drive, not illustrated, and is in the range from 10 m/s to 20 m/s is converted into a finger cage 55 disconnection speed of about 1 m/s to 2 m/s, which is lower by a factor of about 10. As a result of this slower movement of the finger cage 55, the mechanical stress on it as well as that on the contact fingers 56 are advantageously low, so that these components can be designed to be comparatively light and with low mass since they do not have to withstand any large mechanical stresses. Because of the comparatively low speed, no large mechanical reaction forces act on the contact fingers 56, so that the springs which press the contact fingers 56 against the contact surfaces provided on the housing walls 42 and 46 can be designed to be comparatively weak. The wear on the contact points of the contact fingers 56 and on the contact surfaces on which the contact fingers 56 slide is considerably reduced because of the comparatively low spring forces.

The contact pin 3 is guided on the one hand with the aid of the compression piston 51 which slides in the cylinder 58, and on the other hand in a guide part 58. The guide part 58 is connected to the carrier 13 by means of ribs which are arranged in a star shape. Once again, the design ensures that no stray currents can flow from the contact pin 3 into the guide part 58.

In the case of the described embodiments of the power contacts of the power breaker, the contact elements are each designed as identical parts, which are arranged in mirror-image form. The use of identical parts advantageously reduces the production costs of the power breaker and, in addition, simplifies the storage for its spares.

Figure 5:
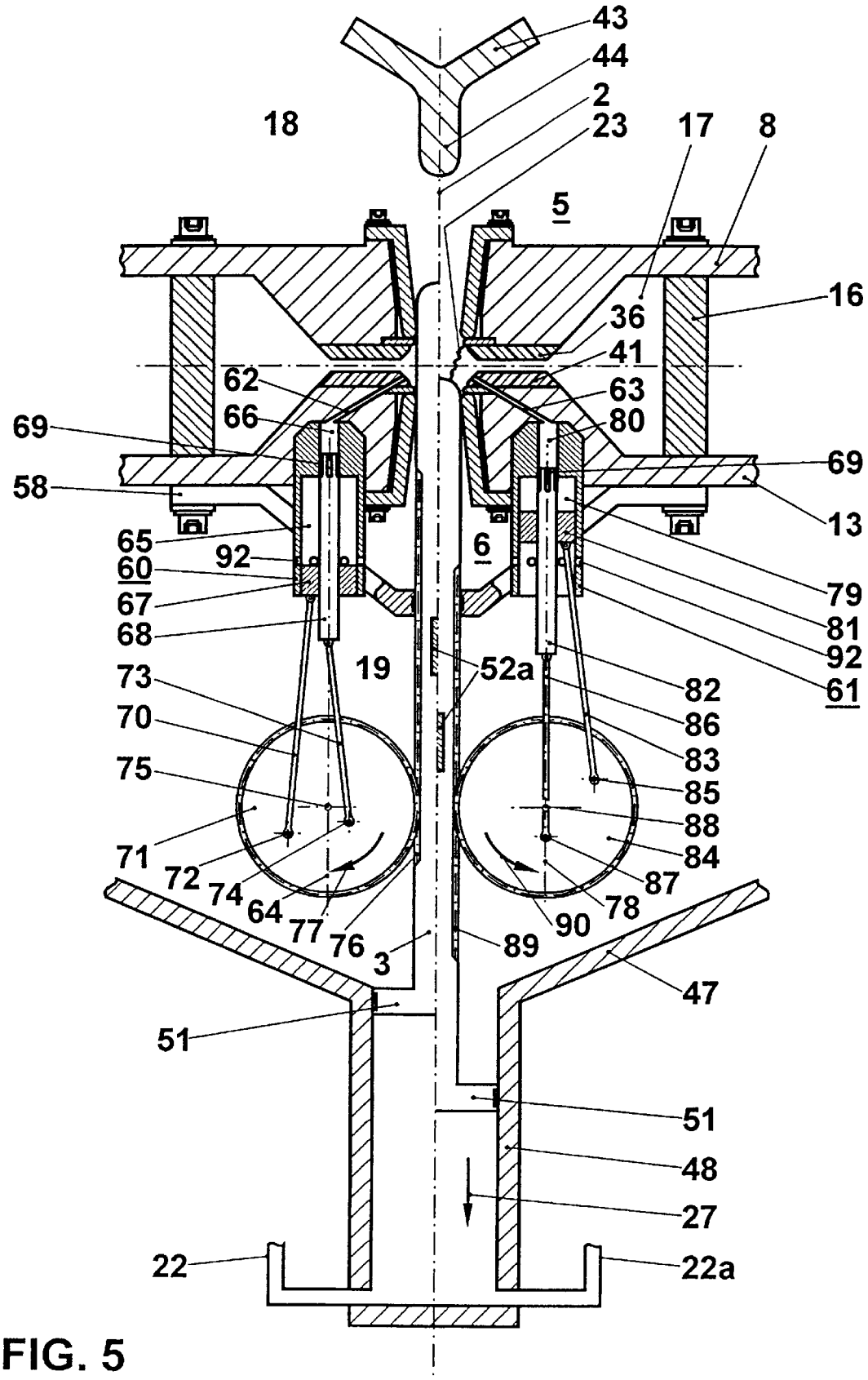
FIG. 5 shows a first highly simplified partial section through a first embodiment of a power breaker according to the invention, the section surface being rotated through 90° about the central axis with respect to the section surfaces illustrated in FIGS. 1 to 4, the power breaker being illustrated in the connected state in the left-hand half of the figure, and the power breaker being illustrated after traveling through about one third of the disconnection movement in the right-hand half of the figure.

FIG. 5 shows a first highly simplified partial section through a first embodiment of a power breaker according to the invention, this section surface being rotated through 90° about the central axis 2 with respect to the section surfaces illustrated in FIGS. 1 to 4. The power breaker is illustrated in the connected state in the left-hand half of FIG. 5, and the power breaker is illustrated after traveling through about one third of the disconnection movement in the right-hand half of FIG. 5. The power breaker is provided with two physically identically designed compression units 60 and 61 for the compression of the insulating gas, which compression units 60 and 61 are rigidly connected to the carrier 13. It is also possible to provide only one compression unit 60 or else a multiplicity of them. The compression units 60 and 61 are introduced into the carrier 13 such that the injection channels 62 and 63, which emerge from them and open into the arc zone 24, are designed to be as short as possible, so that they have a low dead volume. The injection channel 62 is assigned to the compression unit 60, and the injection channel 63 is assigned to the compression unit 61. As a rule, the axis of the injection channels 62 and 63 passes through the center of the arc zone 24 since, this alignment of the injection channels 62 and 63 allows the insulating gas which is under pressure to blow out the arc 23 most effectively. Alternatively, it is feasible for these axes not to meet in the center of the arc zone 24.

By varying the entry angle of the injection channels 62 and 63, it is possible to optimize the blowing out of the arc 23 and effectively to increase the pressure production resulting from the thermal effects of the arc 23 on the injected insulating gas under pressure. The pressurized insulating gas can also be passed into an annular channel which concentrically surrounds the arc zone 24. A multiplicity of injection channels which are distributed around the circumference then lead from this annular channel into the arc zone 24.

The compression unit 60 is of cylindrical design and has an axis 64, which runs parallel to the central axis 2, and a first compression volume 65 which, when the power breaker is in the connected state, is larger than a downstream second compression volume 66. The first compression volume 65 is acted on by a first compression piston 67. The second compression volume 66 is acted on by a second compression piston 68. The two compression pistons 67 and 68 are equipped in the normal manner with piston rings and sealing rings, which are not illustrated. The second compression piston 68 passes through the first compression piston 67 in its center, in a sliding manner and such that it is sealed. That side of the second compression piston 68 which faces the second compression volume 66 is provided, as can be seen better from FIG. 7, with longitudinally extending grooves 69 on the surface. The dimensions of the first compression volume 65 are matched to the dimensions of the second compression volume 66, such that a sufficiently high blowout pressure is produced for blowing out the arc 23.

The first compression piston 67 is moved by means of a rod 70 which is hinged on it. The rod 70 is connected in a hinged manner at the other end to a bearing point 72 which is mounted on a cog 71. The second compression piston 68 is moved by means of a rod 73 which is hinged on it. The rod 73 is connected at the other end in a hinged manner to a bearing point 74 which is mounted on the cog 71. The cog 71 has a center 75 which is mounted in the housing wall 46 such that it can rotate. The toothed rim of the cog 71 engages in a cog rack 76 which is introduced into the surface of the contact pin 3. When the contact pin 3 is moved in the disconnection direction, that is to say in the direction of the arrow 27, then the cog 71, which is driven by this is rotated in the direction of the arrow 77, and the compression unit 60 is thus driven.

The compression unit 61 is of cylindrical design and has an axis 78, which runs parallel to the central axis 2, and a first compression volume 79. The two axes 64 and 78 lie on a plane with the central axis 2. The first compression volume 79 when the power breaker is in the connected state is larger than a downstream second compression volume 80. The first compression volume 79 is acted on by a first compression piston 81. The second compression volume 80 is acted on by a second compression piston 82. The two compression pistons 81 and 82 are equipped in the normal manner with piston rings and sealing rings which are not illustrated. The second compression piston 82 passes through the first compression piston 81 in its center, in a sliding manner and such that it is sealed. That side of the second compression piston 82 which faces the second compression volume 80 is provided, as can be seen better from FIG. 7, with longitudinally extending grooves 69 on the surface. The dimensions of the first compression volume 79 are matched to the dimensions of the second compression volume 80, such that a sufficiently high blowout pressure is produced for blowing out the arc 23.

The first compression piston 81 is moved by means of a rod 83 which is hinged on it. The rod 83 is connected in a hinged manner at the other end to a bearing point 85 which is mounted on a cog 84. The second compression piston 82 is moved by means of a rod 86 which is hinged on it. The rod 86 is connected at the other end in a hinged manner to a bearing point 87 which is mounted on the cog 84. The cog 84 has a center 88 which is mounted in the housing wall 46 such that it can rotate. The toothed rim of the cog 84 engages in a cog rack 89 which is introduced into the surface of the contact pin 3. When the contact pin 3 is moved in the disconnection direction, that is to say in the direction of the arrow 27, then the cog 84, which is driven by this is rotated in the direction of the arrow 90, and the compression unit 61 is thus driven.

Figure 6:
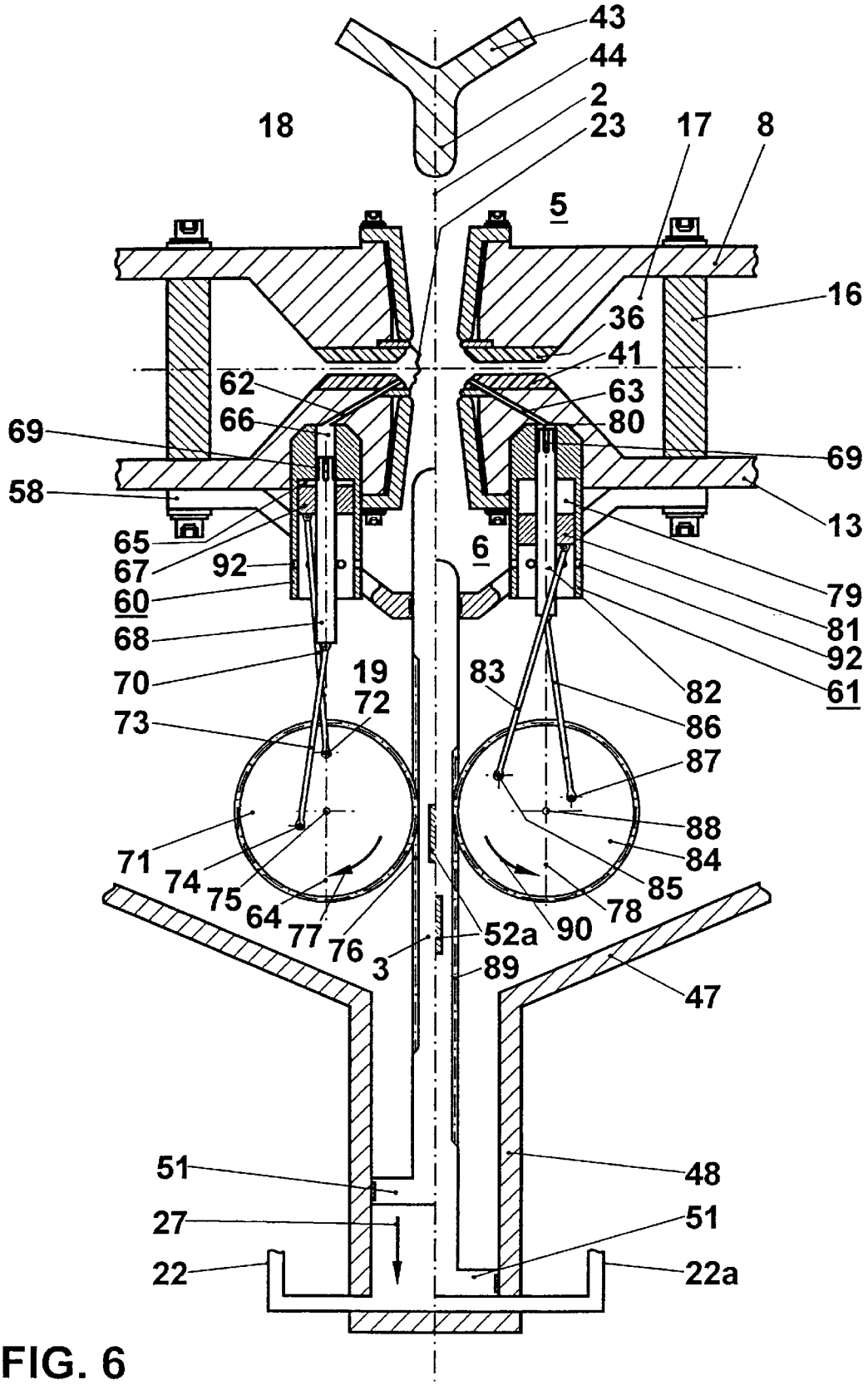
FIG. 6 shows a second highly simplified partial section through the first embodiment of a power breaker according to the invention, this section surface corresponding to that in FIG. 5, the power breaker being shown after traveling through about two thirds of the disconnection movement in the left-hand half of the figure, and the power breaker being illustrated in the disconnected state in the right-hand half of the figure.
Figure 7:
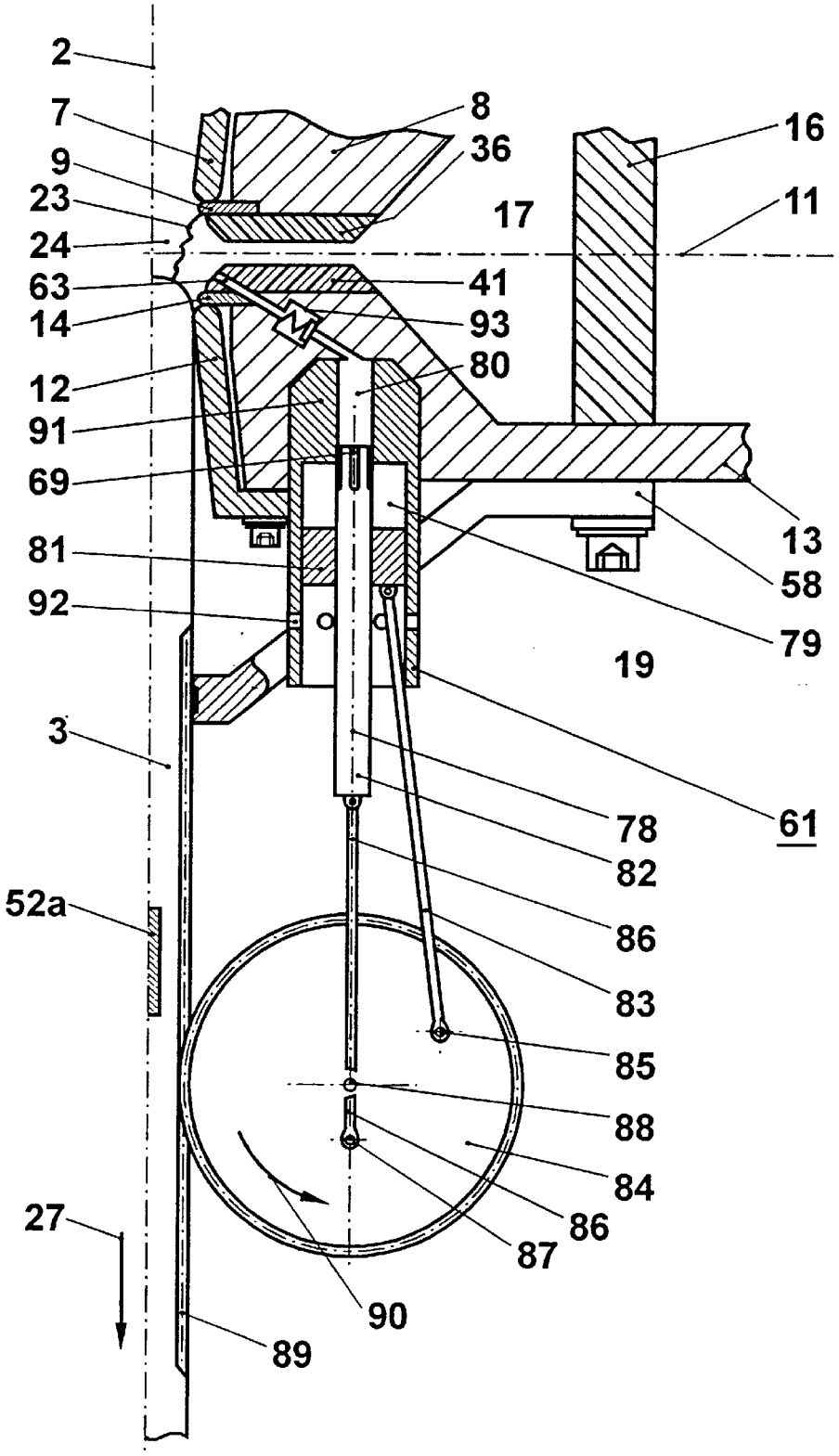
FIG. 7 shows a third highly simplified partial section through a third embodiment of a power breaker according to the invention, this arrangement being based on the arrangement shown on the right-hand side in FIG. 5.

FIG. 7 shows a third highly simplified partial section through a third embodiment of a power breaker according to the invention, this arrangement being based on the arrangement shown on the right-hand side in FIG. 5. It also shows some of the design details of the compression units 60 and 61, which are harder to see in FIGS. 5 and 6 because of the comparatively small scale there. The compression units 60 and 61 each have a housing 91 into which cylinders are incorporated for the respective first compression pistons 67 and 81, respectively, and second compression pistons 68 and 82, respectively. The cylinder which bounds the first compression volume 65 or 79, respectively, in each case has a wall through which holes 92 pass. The holes 92 are positioned such that, when the power breaker is in the connected state, they connect the first compression volume 65 or 79, respectively, to the evacuation volume 19, so that the insulating gas can fill this volume, and this corresponds to the position illustrated on the left-hand side in FIG. 5. As soon as the disconnection movement of the contact pin 3 in the direction of the arrow 27 starts, the respective first compression piston 67 or 81, respectively, closes these holes 92, and the first compression volume 65 or 79, respectively, is closed.

In the course of the injection channel 63, FIG. 7 also shows a schematically indicated overpressure valve 93 which does not allow this highly pressurized insulating gas to flow out through the injection channel 63 into the arc zone 24 until the pressure of the insulating gas in the second compression volume 80 has exceeded a predetermined threshold value. These threshold values may be in the range around 100 bar. In this case, care must be taken to ensure that both the injection channel 63 and the overpressure valve 93 have a dead volume which is as small as possible, in order to avoid any reduction in the pressure of the flowing highly pressurized insulating gas, so that the overall pressure produced in the compression unit 61 is available for blowing out the arc 23. It is now actually possible to equip only one of the two compression units 60 and 61 with the overpressure valve 93, which results in the advantage that, while blowing out the arc 23 by means of the pressure gas which is produced in the first compression unit 60, a sudden rise in the intensity of blowing occurs if the overpressure valve 93 additionally opens the injection channel 63 for the injection of insulating gas, which takes place at a higher pressure, from the compression unit 61. If a plurality of compression units are provided, then the installation of a number of overpressure valves 93 and their response pressures may be optimized in accordance with the operational requirements.

The separate compression units 60 and 61, as are illustrated, for example, in FIGS. 5 to 7, could also be designed as a single, integral compression unit. This compression unit would then be constructed in an annular shape around the central axis 2. The first compression piston would be designed as a closed ring which would operate in an annular, first compression volume. The second compression piston could likewise be designed as an annular piston, which would operate in a correspondingly designed second compression volume. Alternatively, it is feasible for the first compression piston to be designed as a closed ring, while the second compression piston is constructed from a multiplicity of individual single pistons which are distributed around this ring and which slide in a corresponding number of cylindrically designed second compression volumes.

The drive described above for the compression units 60 and 61, by means of the cog racks 76 and 89 which are incorporated in the contact pin 3 and into which cogs 71 and 84, respectively, engage, whose rotation through 180° produces the entire disconnection movement of the compression units 60 and 61, represents only one of the drive options. By means of a further lever linkage, which has toggle levers which are hinged on the contact pin 3, the compression units 60 and 61 can be moved directly and effectively.

Figure 8:
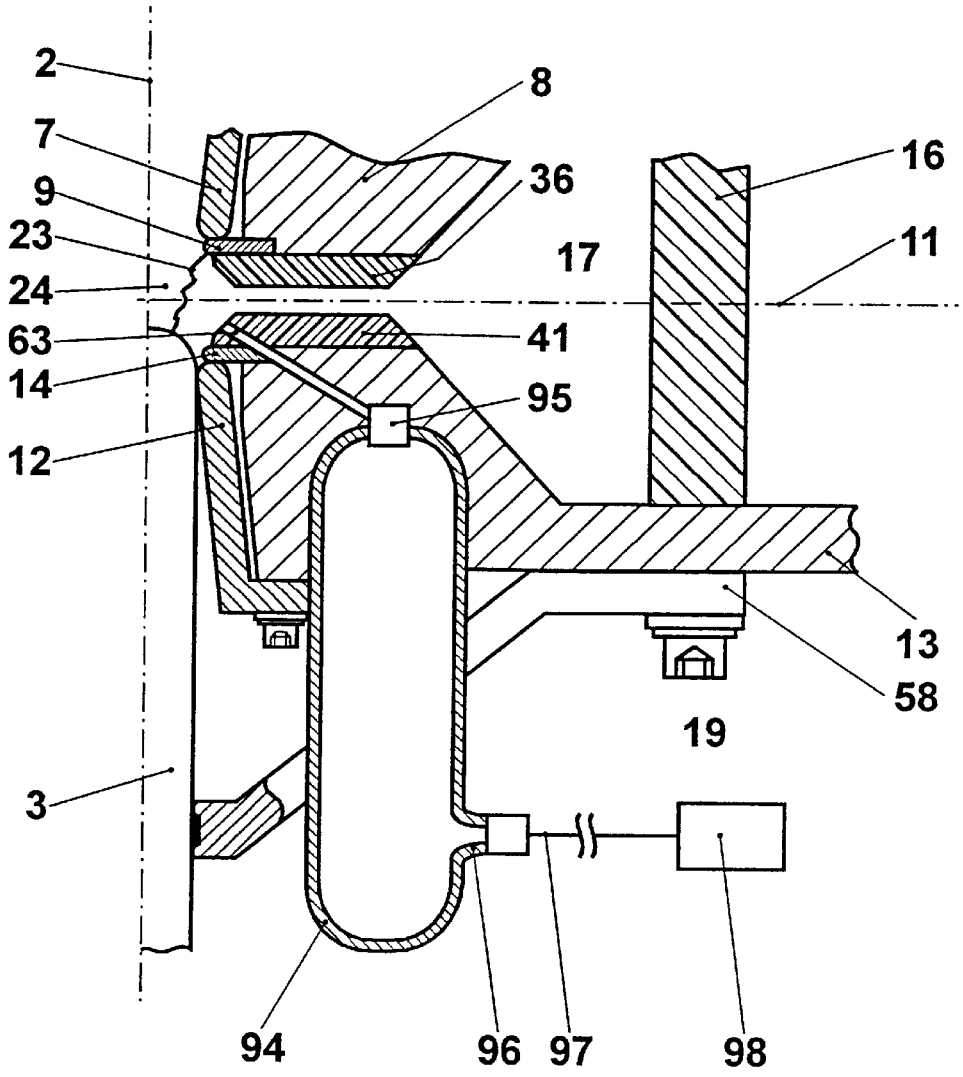
FIG. 8 shows a fourth highly simplified partial section through a fourth embodiment of a power breaker according to the invention, and FIG. 9 showing a fifth highly simplified partial section through a fifth embodiment of a power breaker according to the invention.

Instead of the compression units 60 and 61, it is also possible to install one or more high-pressure containers 94 which are filled with insulating gas which, as a rule, is liquid, as can be seen from FIG. 8, which shows a fourth highly simplified partial section through a fourth embodiment of a power breaker according to the invention. A solenoid valve 95, which is connected upstream of the injection channel 63 which continues onward, is provided in the case of the high-pressure container 94 which is shown there. This solenoid valve 95 is operated electromagnetically by the superordinate protection of the system in the event of a fault-current disconnection occurring, particularly in the event of short-circuit disconnection, so that the pressurized insulating gas is injected directly into the arc zone 24 through the injection channel 63 at the correct instant. The solenoid valve 95 is in each case closed again after a predetermined open time, in order to keep the consumption of the highly pressurized insulating gas low. Alternatively, it is possible to open this solenoid valve 95 during every disconnection, irrespective of the magnitude of the disconnection current. This high-pressure container 94 is provided with a pressure monitor, which is not illustrated. Incorporated in the high-pressure container 94 is an eye 96, to which a pressure line 97 is connected through which fresh $SF_6$ gas is fed under high pressure into the high-pressure container 94, and in each case replaces the $SF_6$ gas which has been consumed. The insulating gas which is additionally fed into the power breaker during switching must be dissipated again from the evacuation volumes 18 and 19 after switching, and must be prepared, in order to avoid those housing parts which are subject to pressure being overloaded. The insulating gas which has been dissipatd is cleaned in a preparation device 98, is then pressurized once again and is then fed back through the pressure line 97 into the high-pressure container 94. As a rule, as well as the power breaker, the preparation device 98 will operate at earth potential, so that its supply line, which is not illustrated, and the pressure line 97 must be manufactured at least partially from insulating material in order to allow the potential difference to be bridged.

The embodiment of the power breaker which is illustrated in FIG. 8 can be simplified by omission of the cylinder 48 and the compression piston 51. The guidance function which the compression piston 51 has for the contact pin 3 would then have to be provided, however, by another structural element. The production of pressure in the arc zone 24 can be advantageously improved by using blowout coils, as are illustrated in FIG. 3, particularly in the time period of disconnection as well, where the pressure injection is not yet fully effective. The design variants shown here may be combined with one another as required, matched to the respective operational requirements.

In the case of the embodiment of the power breaker in which the pressure injection is not triggered in the event of normal operational disconnections, it makes sense to raise, as required, the blowout pressure reduction caused by the thermal effect of the arc 23. If the arc 23 is caused to rotate about the central axis 2, then, as is known, this considerably reinforces the heating of the arc zone 24. As a rule, this rotation is achieved by installing one or more blowout coils in a known manner in the region of the contact zone of a power breaker. The magnetic field of the blowout coils causes the arc 23 to rotate. In the case of the present power breaker, the blowout coils could in each case be introduced into a depression in the carrier 8 or 13, as is shown in FIG. 3. This comparatively simple and effective measure allows the consumption of the insulating gas stored in the high-pressure containers 94 to be reduced considerably, since the high-current short circuits for whose disconnection this additional high-pressure injection of insulating gas is effectively required then occur comparatively very rarely.

Figure 9:
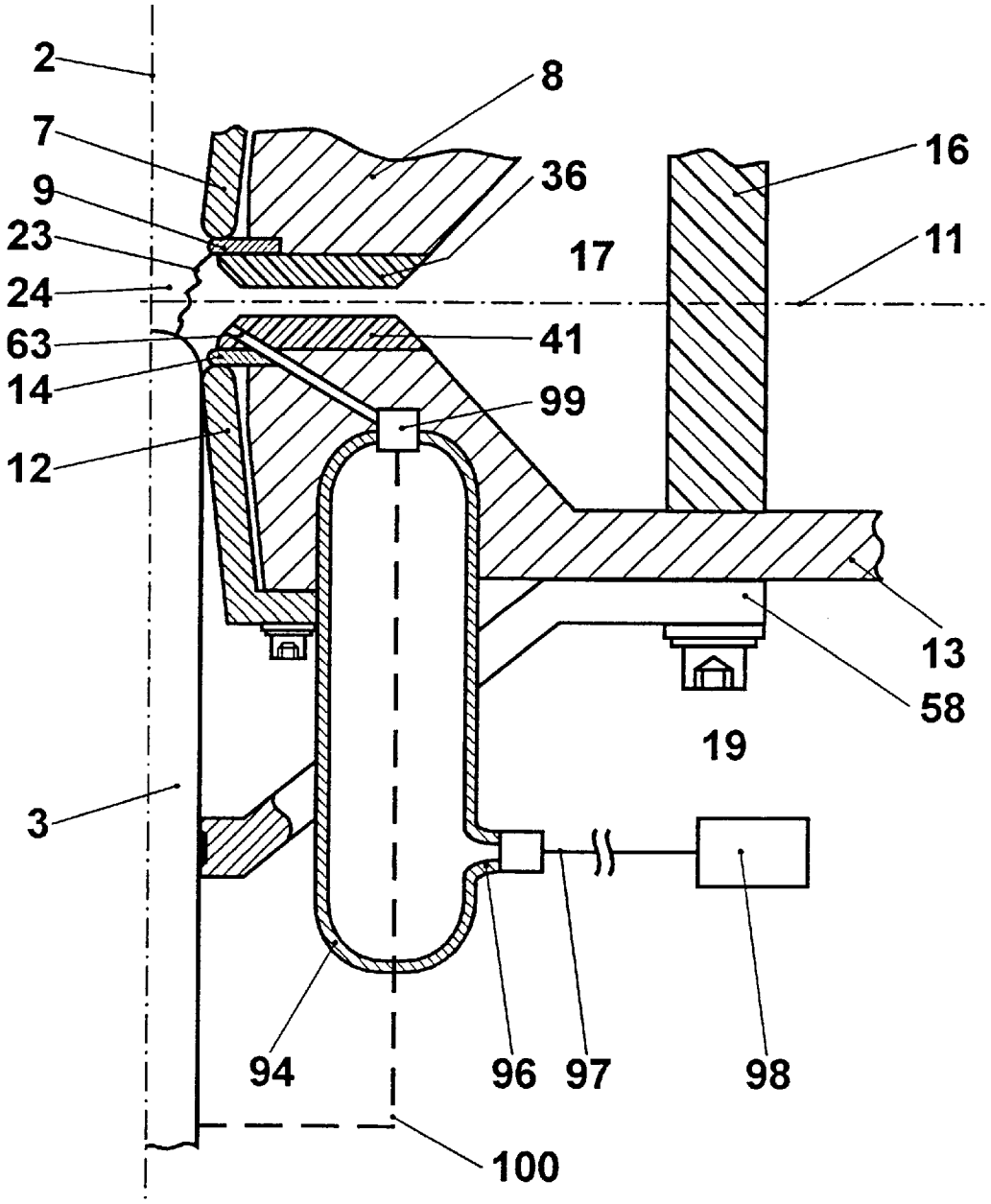

FIG. 9 shows a fifth highly simplified partial section through a fifth embodiment of a power breaker according to the invention. The high-pressure container 94 is in this case closed by an injection valve 99 which is driven directly by and as a function of the movement of the contact pin 3. A dashed line of action 100 which connects the contact pin 3 to the injection valve 99 indicates this interaction. This injection valve 99 is operated during every disconnection such that it opens at the correct instant and closes again reliably after a predetermined open time. The insulating gas which is additionally fed into the power breaker during disconnection must also be dissipated from the evacuation volumes 18 and 19 again after switching in this case, and must be prepared, in order to avoid overloading the housing parts which are subject to pressure. The dissipated insulating gas is cleaned in a preparation device 98, is then repressurized and is fed back through the pressure line 97 into the high-pressure container 94. This design variant is particularly suitable for power breakers which are used as generator switches and, as a rule, carry out only a comparatively small number of switching operations in operation.

The use of high-pressure containers 94 is also feasible for generator switches, their insulating gas filling being dimensioned such that it is adequate for all possible short-circuit disconnections until the next contact inspection, which is required anyway. Repreparation of the insulating gas and its return would then not be necessary. The injected insulating gas could then be sucked out during the contact inspection, and the emptied high-pressure container 94 could be replaced by a full one. In the case of this design of the power breaker, a solenoid valve 95 which is triggered by the superordinate system protection would have to be used as the valve, as a result of which the gas consumption could be kept low. This solenoid valve 95 also closes after a predetermined open time. The evacuation volumes 18 and 19 would then, however, have to be dimensioned such that the insulating gas which is injected and initially remains in it cannot cause any pressure overloading of the housings which enclose it.

The figures will now be considered in somewhat more detail in order to explain the method of operation. During disconnection, the contact pin 3 draws an arc 23 between the consumable plates 9 and 14 in the course of its disconnection movement. The contact pin 3 is moved at a comparatively very high disconnection speed, so that the arc 23 burns only briefly on the tip 4 of the contact pin 3 and then commutates onto the consumable plate 14. The tip 4 therefore exhibits scarcely any traces of erosion. The consumable plates 9 and 14 are made of particularly erosion-resistant material and they therefore have a comparatively long life. The consumable contacts of the power breaker therefore need to be inspected only comparatively rarely, as a result of which said power breaker has comparatively high availability.

Because of the very fast disconnection movement of the contact pin 3, the arc 23 will reach its full length comparatively quickly, so that, even very shortly after contact separation, all the arc energy is available for pressurizing the insulating gas in the arc zone 24. The arc 23 acts thermally on the insulating gas surrounding it and thus briefly increases the pressure in the arc zone 24 of the quenching chamber. The pressurized insulating gas is briefly stored in the storage volume 17. However, some of the pressurized insulating gas flows on the one hand through an opening 25 into the evacuation volume 18, and on the other hand through an opening 26 into the evacuation volume 19. As a rule, however, the contact pin 3 is connected to a single-stage piston-cylinder arrangement, in which insulating gas is compressed during a disconnection process. This compressed insulating gas is introduced through the line 22 into the storage volume 17, in addition to the thermally produced pressurized insulating gas.

However, this inward flow takes place only if the pressure in the storage volume 17 is lower than in the line 22 or 22*a*. This is the case, for example, before contact separation or when the current in the arc 23 is so weak that it cannot heat the arc zone 24 sufficiently intensively. However, if a high-current arc 23 heats the arc zone 24 very intensely, so that a comparatively high insulating gas pressure occurs in the storage volume 17, then the compressed gas produced in the piston-cylinder arrangement does not initially flow inwards at this high pressure. If a predetermined stored pressure limit is exceeded in the storage volume 17, then an overpressure valve 29 opens after this predetermined limit has been exceeded, and the excess pressure is dissipated into the evacuation volume 18. This provides a high level of safety that the mechanical load capacity of the structural elements cannot be unacceptably exceeded in this area.

As long as there is an overpressure in the arc zone 24, very hot ionized gas also flows away through the openings 25 and 26 into the evacuation volumes 18 and 19. With regard to the structural design of these two flow areas, care has been taken to ensure that they have been designed to be geometically similar, in order to achieve identical outlet flow conditions in both evacuation volumes 18 and 19. The tip 4 of the contact pin 3 is arranged at the center of the evacuation volume 19 opposite the opening 26 and, together with the ribs on the guide part 57, influences the gas flow in this area. The flow deflector 44 is arranged in the evacuation volume 18 at the point corresponding to the tip 4 opposite the opening 25, and influences the gas flow there in a similar manner. Because the flow areas are of very similar design, the two gas flows are formed in a similar manner, so that the pressure which builds up in the arc zone 24 flows away approximately uniformly and in a controlled manner on both sides, as a result of which the insulating gas which is present in the storage volume 17 for quenching the arc 23 can be stored under pressure until it is possible to blow out the arc 23.

In addition, the blow out pressure which acts in the arc zone 24 in this embodiment of the power breaker is considerably increased by the high-pressure injection, which takes place directly into the arc zone 24. In this case, the arc 23 is blown out particularly effectively.

FIGS. 5 and 6 illustrate how the compression units 60 and 61 operate. In the connected state, that is to say as illustrated in the left-hand half of FIG. 5, the holes 92 are open and the insulating gas, this being $SF_6$ gas in this case by way of example and which as a rule is acted on by a filling pressure of about 6 bar, fills the first compression volume 65 or 79 at this pressure. As soon as the contact pin 3 starts its disconnection movement in the direction of the arrow 27, it drives the cog 71 or 84. The cogs 71 and 84 are in each case rotated in the direction of the associated arrows 77 and 90. At the same time, the lever linkage is operated via the bearing 52*a* and moves the contact fingers 56 of the rated current path in the disconnection direction. Only that one of the two compression units 60 and 61 which is being considered in each case will be described further from now on. The rod 70 which is attached to the bearing point 72 now moves the first compression piston 67 upwards in the opposite direction to the direction indicated by the arrow 27, and this converts the rotary motion into a linear motion. At the same time, the second compression piston 68 is moved slightly downwards, so that the $SF_6$ gas compressed in the first compression volume 65 can flow into the second compression volume 66 through the grooves 69. The $SF_6$ gas is compressed simultaneously in both volumes in this compression phase.

The right-hand half of FIG. 5 illustrates how the bearing point 87 at which the rod 86 which moves the second compression piston 82 is mounted passes through a dead point. The second compression piston 82 reverses its direction of motion here and from now on moves upwards. The first compression piston 81 keeps the same direction of motion as before and, in consequence, further raises the pressure in the first compression volume 79. The grooves 69 still connect the first compression volume 79 to the second compression volume 80. The left-hand half of FIG. 6 illustrates the switching time at which the second compression piston 68 has slid so far into the second compression volume 66 that the grooves 69 are just closed, so that no further pressure equalization is possible from now on between the two volumes. The intermediate pressure in the first compression volume 65 and in the second compression volume 66 has now risen by 10 to 15 times the original pressure. The bearing point 72 of the rod 70 has now likewise moved into a dead point position, and the first compression piston 67 reverses its direction of motion. As the right-hand side of FIG. 6 shows, the second compression piston 82 compresses the intermediate pressure in the second compression volume 80 further by 10 to 15 times, until it reaches its limit position. At the same time, the first compression piston 67 has been moved downwards, and the pressure in the first compression volume 65 corresponds approximately to the original pressure of 6 bar again in the limit position shown.

The details relating to the compression values have been obtained subject to the precondition that no pressure flows away through the injection channels 62 and 63 during the compression process. However, this assumption is relatively accurate only when, as shown in FIG. 7, overpressure valves 93 prevent such flowing away until its response pressure is reached. For particular operational conditions, it is thus actually worthwhile to design the blowing out of the arc 23 such that it occurs comparatively late, but has a more powerful effect for this purpose, as is achieved by the design having the overpressure valve 93 according to FIG. 7.

Alternatively, it may always be worthwhile for some compressed $SF_6$ gas to be dissipated from the first compression volume 65 or 79 and to be used for blowing out the arc 23 before the actual high-pressure injection starts. This blowing is advantageously likewise carried out through the injection channels 62 and 63 directly into the arc zone 24. In this blow variant, a flow channel is provided which connects the first compression volume 65 or 79, respectively, past the second compression volume 66 or 80, respectively, to the injection channel 62 or 63, respectively. This may be particularly advantageous, for example, if it is necessary to disconnect small inductive currents. The arc 23 is then blown early and comparatively less intensively so that it does not tear away, and is extinguished when the high-pressure injection is effective. In this way, high switching overvoltages can be avoided in a simple manner.

The blowing of the arc 23 can be varied in various ways. As already stated, it can be assisted by blowout coils 30 and 31 as well as by $SF_6$ gas which is additionally compressed in a single-stage piston-cylinder arrangement and is introduced into the storage volume 17. In addition, the high-pressure injection can be reduced as required and can be optimally matched to the respective operational conditions of the power breaker.

Insulating liquids can also be used as a compressed insulating medium for the present power breaker. In this case, it may be worthwhile not injecting this medium directly into the arc zone 24. Particularly in the case of liquefied gases, it may under some circumstances be more favorable to inject these gases into the storage volume 17 first.

The power breaker designs having high-pressure containers 94 can also be modified by means of blowout coils 30 and 31 as well as by $SF_6$ gas which is additionally compressed in a single-stage piston-cylinder arrangement and is introduced into the storage volume 17, so that these power breakers can also be optimally matched to the respective operational requirements.

The power breaker according to the invention is particularly well suited for switchgear in the medium-voltage range. The compact cylindrical design of the power breaker is particularly suitable for installation in metal-encapsulated systems, in particular for installation in metal-encapsulated generator output lines as well. In addition, the power breaker is particularly well suited for replacement of obsolete power breakers since, for the same or an improved breaking capacity, it has a considerably smaller space requirement than them and, as a rule, no costly structural changes are required for such a conversion. If it is intended to use the power breaker for operational voltages above about 24 kV to 30 kV, then the distances a and b must be increased and must be matched to the required voltage, and the disconnection speed of the contact pin 3 must also be appropriately adapted, if necessary, that is to say must be increased.

The connection speed of the contact pin 3 in this power breaker is in the range 5 m/s to 10 m/s, while the contact fingers 56 of the moving rated current contact move to their connected position at a connection speed in the range from 0.5 m/s to 1 m/s, corresponding to the values predetermined by the speed-reducing lever linkage.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A power breaker comprising:

at least one quenching chamber filled with an insulating medium, said quenching chamber being of cylindrical design and extending along a central axis, said at least one quenching chamber including a power current path having two stationary consumable contact arrangements which are arranged on the central axis and spaced at a distance from one another in the axial direction, said two stationary consumable contact arrangements having a moving bridging contact which electrically conductively connects the consumable contact arrangements in a connected state, an arc zone which is provided between the stationary consumable contact arrangements and a rated current path arranged in parallel with the power current path and provided with moving rated current contacts, wherein at least one source is provided for the insulating medium on which high pressure acts, and wherein said at least one source is connected directly to the arc zone by means of at least one injection channel.

2. The power breaker as claimed in claim 1, wherein the bridging contact is designed as a contact pin which is arranged in the interior of the consumable contact arrangements and extends along the central axis, wherein the contact pin is driven at a disconnection speed in the range from 10 m/s to 20 m/s, wherein the contact pin is connected to the moving rated current contacts via at lease one lever linkage, and wherein the lever linkage is designed such that the rated current contacts always move at a lower speed than the contact pin.

3. The power breaker as claimed in claim 1, wherein an overpressure valve is provided in the at least one injection channel.

4. The power breaker as claimed in claim 1, wherein the moving rated current contacts of the rated current path are arranged in a space completely separated from the arc zone.

5. The power breaker as claimed in claim 1, wherein a nozzle zone is arranged between the stationary consumable contact arrangements, wherein said nozzle zone is designed in an annular shape and opens into a storage volume which is designed in an annular shape and is bounded by an insulating separating wall.

6. The power breaker as claimed in claim 1, wherein components of the consumable contact arrangements are designed as identical parts which are arranged in mirror-image symmetry with respect to a plane of symmetry which is arranged at right angles to the central axis.

7. The power breaker as claimed in claim 1, wherein the at lease one source has at least one high-pressure container which is filled with a highly pressurized insulating medium, and wherein a valve which is connected to the high-pressure container opens and closes, as required, an entry into the injection channel of the highly pressurized insulating medium.

8. The power breaker as claimed in claim 7, wherein said valve includes a solenoid valve or an injection valve which is switched on and off mechanically as a function of the motion of the bridging contact.

9. The power breaker as claimed in claim 1, wherein the at least one source for the highly pressurized insulating medium has at least one compression unit with at least one first piston-cylinder arrangement which has at least two series-connected pistons, of which a first compression piston precompresses the insulating medium in a first compression volume, and of which a second compression piston further compresses the precompressed insulating medium in a second compression volume, which is separated from the first compression volume, to form an insulating medium on which high pressure acts.

10. The power breaker as claimed in claim 9, wherein the second compression piston is provided with axially extending grooves on a part of the surface which slides in the second compression volume.

11. The power breaker as claimed in claim 9, wherein, in addition to the at least one source for a highly pressurized insulating medium, either a second piston-cylinder arrangement is installed for the production of pressurized insulating gas or wherein the consumable contact arrangements are provided with at least one blowout coil, or wherein the second piston-cylinder arrangement is installed combined with at least one blowout coil in addition.

12. The power breaker as claimed in claim 1, wherein the consumable contact arrangements each have openings on the side facing away from the arc zone, for ionized gases to flow out of the arc zone in a controlled manner into a respective adjacent evacuation volume.

13. The power breaker as claimed in claim 12, wherein the evacuation volumes are each bounded by walls, the first evacuation volume being enclosed by a first housing wall, a first carrier which is connected to the first housing wall, and a closure cover, and the second evacuation volume being enclosed by a second housing wall, a carrier which is connected to the second housing wall, and a cover, wherein the first housing wall is connected to the second housing wall by means of at least one insulating tube, an electrically insulating distance remaining between the two housing walls, and, wherein, in the connected state, contact fingers electrically conductively bridge the electrically insulating distance between the first housing wall and the second housing wall.

14. The power breaker as claimed in claim 13, wherein the first housing wall and the second housing wall are designed as identical parts which are arranged in mirror-image symmetry with respect to a plane of symmetry which is arranged at right angles to the central axis.

* * * * *